United States Patent [19]

Weinberg

[11] Patent Number: 4,664,187

[45] Date of Patent: May 12, 1987

[54] RETRIEVABLE BUSHING FOR WELL CONDUIT

[75] Inventor: Roger A. Weinberg, Houston, Tex.

[73] Assignee: Baker Oil Tools, Inc., Orange, Calif.

[21] Appl. No.: 835,158

[22] Filed: Mar. 3, 1986

[51] Int. Cl.[4] ..... E21B 23/02

[52] U.S. Cl. ..... 166/115; 166/217; 166/382

[58] Field of Search ..... 166/115, 381, 382, 387, 166/117, 181, 208, 217

[56] References Cited

U.S. PATENT DOCUMENTS

| | | | |
|---|---|---|---|
| 3,990,510 | 11/1976 | Decuir | 166/217 X |
| 4,372,393 | 2/1983 | Baker | 166/217 X |
| 4,437,522 | 3/1984 | Krause, Jr. et al. | 166/217 X |
| 4,482,014 | 11/1984 | Allwin | 166/217 X |
| 4,508,167 | 4/1985 | Weinberg et al. | 166/382 X |
| 4,513,817 | 4/1985 | Weinberg | 166/217 X |

*Primary Examiner*—Stephen J. Novosad
*Assistant Examiner*—David J. Bagnell
*Attorney, Agent, or Firm*—Norvell & Associates

[57] ABSTRACT

A removable bushing for slidably and sealably supporting a mandrel within the bore of a well conduit comprises an outer tubular body insertable in the well conduit in series relation. Said outer tubular body defines an internal seal bore and an annular latching recess adjacent the seal bore. An internal tubular body assembly is telescopically inserted in the well conduit and carries external seals engagable with the seal bore and an internal seal stack. The internal tubular body further comprises a collet having a plurality of peripherally spaced locking arms terminating in locking heads which are engagable with the annular recess in the outer tubular body. A mandrel is inserted within the bore of the outer tubular body in sealing engagement with the internal seal stack. A plurality of peripherally spaced locking lugs are carried by a sleeve on the exterior of the mandrel and are positioned by further downward movement of the mandrel beneath the locking heads of the collet arms, thus locking the collet heads in position. Upward movement of the mandrel will produce a displacement of the locking heads of the collet from engagement with the annular recess in the outer tubular body assembly and permit the concurrent removal of the mandrel and the inner tubular body assembly from the well.

7 Claims, 7 Drawing Figures

RETRIEVABLE BUSHING FOR WELL CONDUIT

BACKGROUND OF THE INVENTION

1. Field of the Invention:

The invention relates to a bushing or internal seal which may be run into a well conduit for effecting sealing engagement with a work string-carried mandrel and may be retrieved by the mandrel when the work string operations are completed.

2. Description of the Prior Art:

There are many operations in the completion of a subterranean well wherein it is necessary to provide a bushing or internal seal in the bore of the production string in order to effect a seal with a work string-carried mandrel. For example, see the bushings 11*a* and 12 shown in U.S. Pat. No. 4,479,544. While these bushings operate satisfactorily, they have the disadvantage that they must be milled out after the mandrel has been removed and the work string operations completed. This requires expenditure of valuable time which could be utilized for other completion operations or actual production from the well.

The prior art has not provided a bushing which will effect the necessary sealing action in the above-described environment but which may be readily retrieved when the work string-carried mandrel is removed from the well.

SUMMARY OF THE INVENTION

This invention provides a retrievable bushing involving three major components, namely: an outer tubular assembly which is incorporated in a well conduit, such as a production string; an inner tubular body assemblage which is telescopically inserted in the outer tubular assembly and carries an external seal cooperable with a seal bore provided in the outer tubular assemblage, and an internal stack of seals which function as a bushing or seal; and a work string-carried tubular mandrel assembly which sealably engages the internal seals carried by the inner tubular body assemblage. The outer tubular assembly further defines an upwardly facing no-go shoulder and an annular locking recess.

The inner tubular body assemblage incorporates a collet having its ring portion secured to the assembly and its peripherally spaced locking arm portions disposed to have the heads carried by such arms engage the annular locking recess when a downwardly facing no-go shoulder on the inner tubular body assemblage engages the aforementioned upwardly facing no-go surface provided in the outer tubular assembly.

The mandrel assembly defines an annular space between its exterior and the internal surfaces of the collet locking arms. A locking sleeve is mounted on the mandrel assembly in this annular space and such sleeve defines a plurality of peripherally spaced recesses within which are mounted locking blocks or lugs which are radially shiftable with respect to the sleeve. Lastly, the mandrel assembly is provided with an annular recess which is alignable with the locking blocks in the run-in position of the mechanism so as to permit the collet arms to occupy a nonlocking position relative to the outer tubular body assemblage and thus to be freely insertable within such assemblage.

In the run-in position, a retention sleeve carried by the mandrel assembly overlaps the extreme lower end of the collet locking arms to insure that these arms are held in a retracted position during assembly of the tool.

A shear pin connects the mandrel to the inner tubular body assembly during the run-in of the tool. When the inner tubular body assembly bottoms out on the no-go shoulder provided in the tubular outer assembly, further downward movement of the mandrel assembly will effect the shearing of the shear pin and move the retention sleeve out of engagement with the ends of the collet locking arms. Further, downward movement of the mandrel assembly will move the annular recess away from the locking blocks and produce an outward camming of such locking blocks, which in turn moves the collet arms into locking engagement with the annular locking recess in the outer tubular assembly.

The end surface of the retention sleeve is inclined so as to exert a camming action on the ends of the collet arms when the mandrel assembly is moved upwardly for withdrawal purposes. Such inclined surface engages a similarly inclined surface on the ends of the collet locking arms and cams such locking arms inwardly so that the locking heads on the collet arms are moved out of engagement with the annular recess in the outer tubular assembly when the mandrel assembly is moved upwardly for removal of the mandrel and inner tubular body assembly. An upwardly facing surface is provided on the mandrel assembly immediately below the recesses that accommodate the locking blocks so that upward movement of the mandrel will engage the locking block carrying sleeve and move the locking blocks upwardly to release the collet locking arms from the locking position and permit the inner tubular body assemblage to be removed from the well conduit with the mandrel.

In a modification of this invention, a pressure equalization sub is incorporated in the mandrel assembly to equalize fluid pressure above and below the internal seals during retrieval of the mandrel assembly and the inner tubular body assembly.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 3:
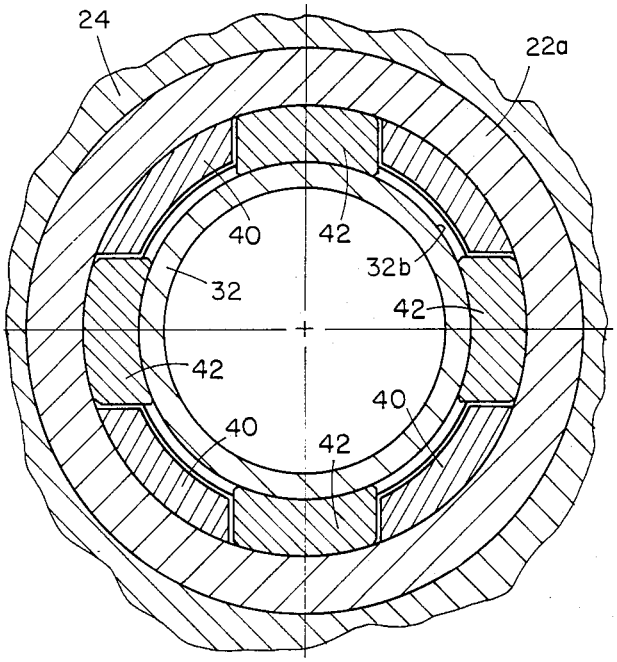
FIG. 3 is a sectional view taken on the plane 3—3 of FIG. 1B.

Referring to the drawings, a removable bushing 1 embodying this invention comprises an outer tubular assembly 10 which is insertable in series relation in a well conduit, for example in a production string (not shown). An inner tubular body assembly 20 is insertable within the bore of the outer tubular body assembly and at a desired location is locked to the outer tubular body assembly through the engagement of collet locking heads 23, which are mounted on a collet 22, with an annular recess 11 provided in the outer tubular assembly 10. The inner tubular body assemblage 20 includes an internal seal stack 26 which is sealably engagable with a work string-carried mandrel 30. Mandrel 30 carries a plurality of radially shiftable locking dogs 42 which function to lock the locking heads 23 of the collet 22 in engagement with the recess 11, as will be described. The mandrel 30 includes a removal sleeve 34 for effecting the removal from the well of the inner tubular body assemblage with the mandrel, and a collet arm retention sleeve 38 which holds the collet locking arms in a retracted position during the run-in and removal of the mandrel and the inner tubular body assembly.

In greater detail, the outer tubular assembly 10 comprises an upper tubular connecting portion 10*a* which has its lower end externally threaded and secured, to a lower tubular portion 10*b* by threads 10*c*. The threaded connection 10*f* is sealed by an O-ring 10*d* and secured by a set screw 10*e*. The lower tubular portion 10*b* terminates in a conventional connection to a well conduit (not shown), as does the upper portion 10*a*, and thus, the outer tubular assembly is disposed in series relationship with a well conduit. The lower tubular portion 10*b* has an increased wall thickness portion 10*c* which defines an upwardly facing no-go surface 10*g*, and additionally defines an annular locking recess 11 which cooperates with the locking heads 23 provided on an inner tubular body assembly 20.

The inner tubular body assembly 20 comprises an upper body portion 20*a* defining an upwardly facing external annular shoulder 20*b* and an internal shoulder 20*f* adjacent its upper end. Additionally, internal threads 20*c* are provided in the extreme upper end of the upper tubular body portion 20*a*. A seal mounting sleeve 21 is mounted on the upwardly facing shoulder 20*b* and provides annular recesses for the mounting therein of conventional molded seal units 21*a* which sealably engage the bore 10*h* of the upper portion 10*a* of the outer tubular assembly 10. Seal mounting sleeve 21 is secured in position on the upper tubular element 20*a* by a retaining sleeve 20*d* which is threadably secured to the internal threads 20*c* and overlies the upper end of the seal mounting sleeve 21.

The lower end of the upper body portion 20*a* is reduced in diameter and provided with external threads 20*e*. The lower portion of the inner tubular body assemblage 20 is defined by a collet 22 having a solid ring portion 22*a* at its upper end which is internally threaded to cooperate with the aforementioned external threads 20*e*. A set screw 22*f* secures this threaded connection. Collet 22 has a plurality of peripherally spaced, downwardly extending, resilient arm portions 22*b* which respectively terminate in thickened portions 22*c*, the lower ends of which define retention projections 22*d* for a purpose to be hereinafter described. A locking head 23 is secured to the lower portion of each collet arm 22*b* by bolts 23*a*. Locking heads 23 are located immediately above the retention portions 22*d* of the collet 22.

To position the locking head portions 23 adjacent to the annular locking recess 11 provided in the outer tubular assembly, the internal, upwardly facing, no-go surface 10*g* is located on the upper portions of the lower section 10*b* of the outer tubular assembly 10. A no-go sleeve 24 surrounds the ring portion 22*a* of collet 22 and is secured thereto by bolts 24*a*. No-go sleeve 24 defines a downwardly facing no-go shoulder 24*b* which engages the internal shoulder 10*g* and, when engaged, the locking heads 23 are respectively positioned immediately adjacent to the annular recess 11 in the outer tubular assembly 10.

Lastly, an axially extending stack 26 of conventional annular seal elements is mounted on the upper internal surface of the upper portion 20*a* of the inner tubular body assembly 20 between upwardly facing shoulder 20*f* and retention sleeve 20*d*. These seals provide for a sealing engagement with the periphery of a work string-carried hollow mandrel 30 which is inserted within the bore of the inner tubular body 20.

The mandrel assembly 30 comprises an upper sleeve section 31 which is conventionally connected to a work string (not shown) and provided with external threads 31*a* on its bottom end to threadably engage an intermediate mandrel section 32. The upper end of mandrel section 32 is internally threaded to cooperate with the threads 31*a* and the threaded connection is sealed by an O-ring 32*a*. Below the O-ring 32*a*, the periphery of intermediate mandrel portion 32 is provided with an annular recess 32*b* within which, in the run-in position of the tool elements, are positioned a plurality of peripherally spaced locking dogs or blocks 42. Locking blocks 42 are mounted in peripherally spaced apertures 40*a* provided in a block carrier sleeve 40 which is slidably mounted on the exterior of the mandrel 30.

An abutment sleeve 34 is secured to the exterior of mandrel 30 in a position to abut the lower end of the block carrying sleeve 40 in the run-in position of the mandrel. Abutment sleeve 34 comprises a split ring element having external threads 34*a* which are engaged by an internally threaded lock ring 35 and secured by a set screw 35*a*.

A second annular recess 32*c* is provided in intermediate mandrel portion 32 at a position to underlie the bottom ends of the collet arms 22*b* and particularly, to underlie the locking heads 23 and the retention portions 22*d* of the collet 22. Below the annular recess 32*c*, a retention sleeve 38 is secured to the mandrel portion 32 and the upper end portion of sleeve 38 is counterbored as shown at 38*a* so as to permit such end portion to overlie the retention portions 22*d* of the collet arms 22*b*. Sleeve 38 is held in this position against a downwardly facing shoulder 32*d* formed on intermediate mandrel portion 32, and the upper end of a lower mandrel portion 36 which is threadably engaged with external threads 32*e* formed on the bottom end of intermediate collet portion 32. This threaded connection is sealed by an O-ring 36*a*. The lower portion (not shown) of the lower mandrel portion 36 is conventionally connected to whatever tool is being employed in the well.

Figure 1A:
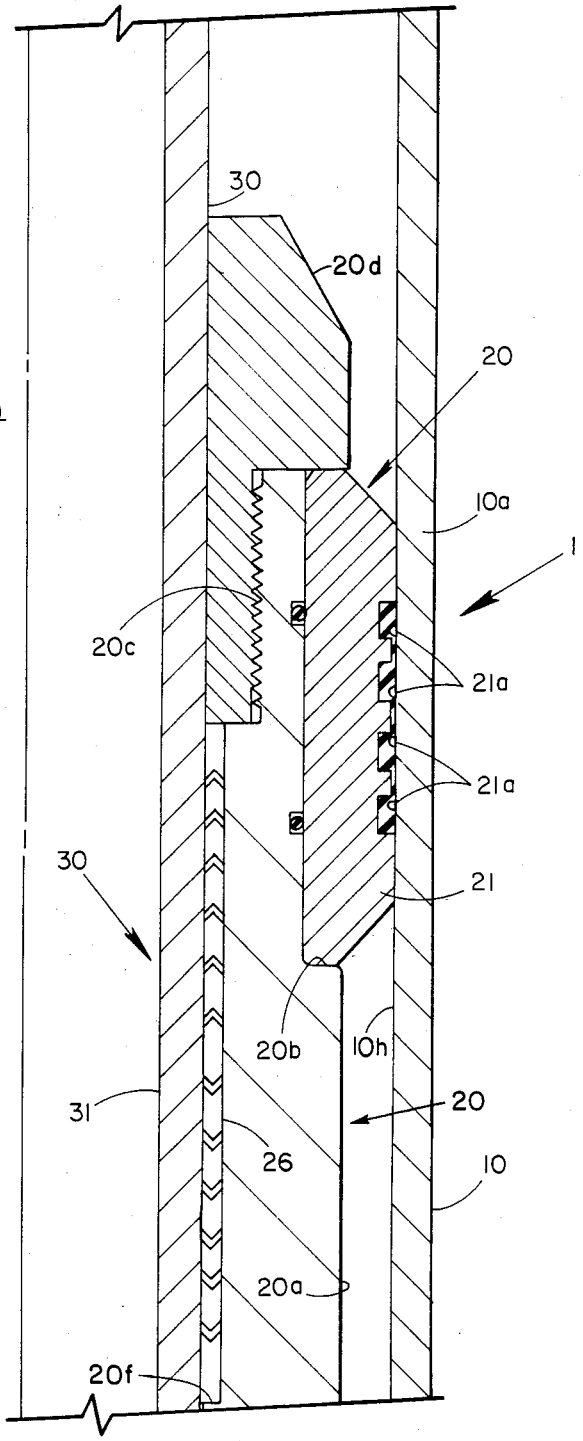
FIGS. 1A, 1B, and 1C, collectively, represent a quarter-sectional view of a retrievable bushing assembly embodying this invention shown in its run-in position relative to a well conduit.
Figure 1B:
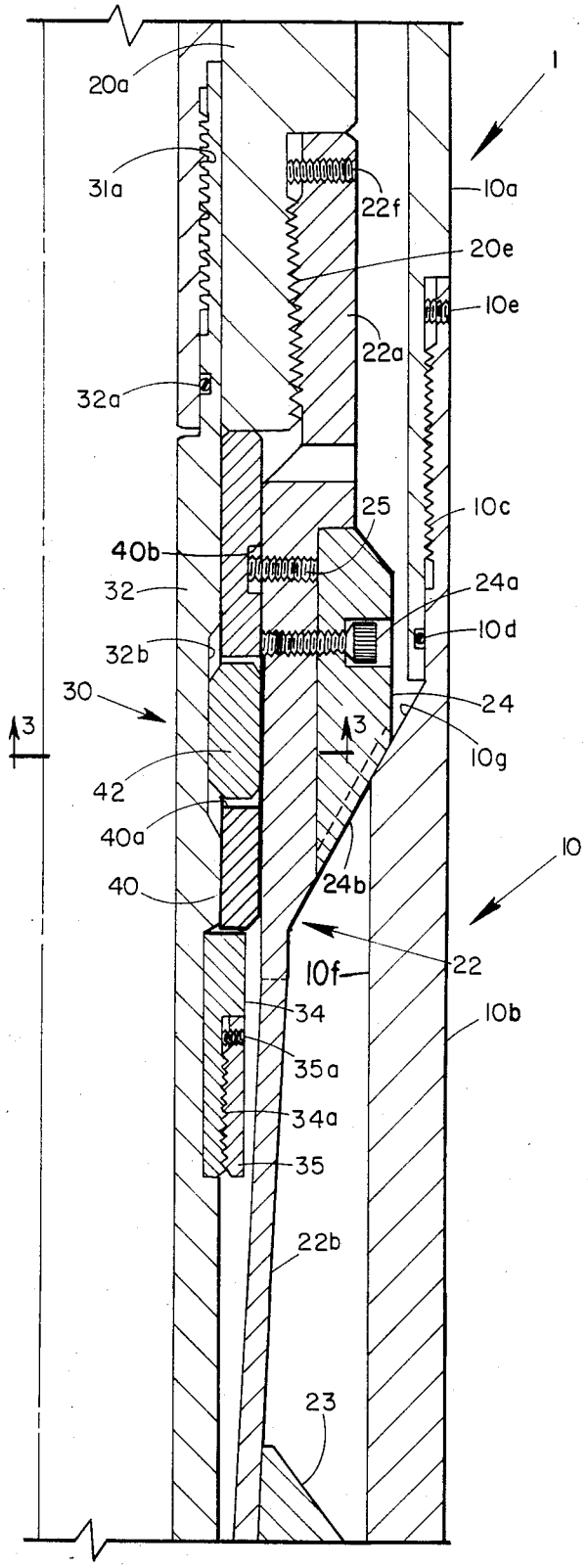
Figure 1C:
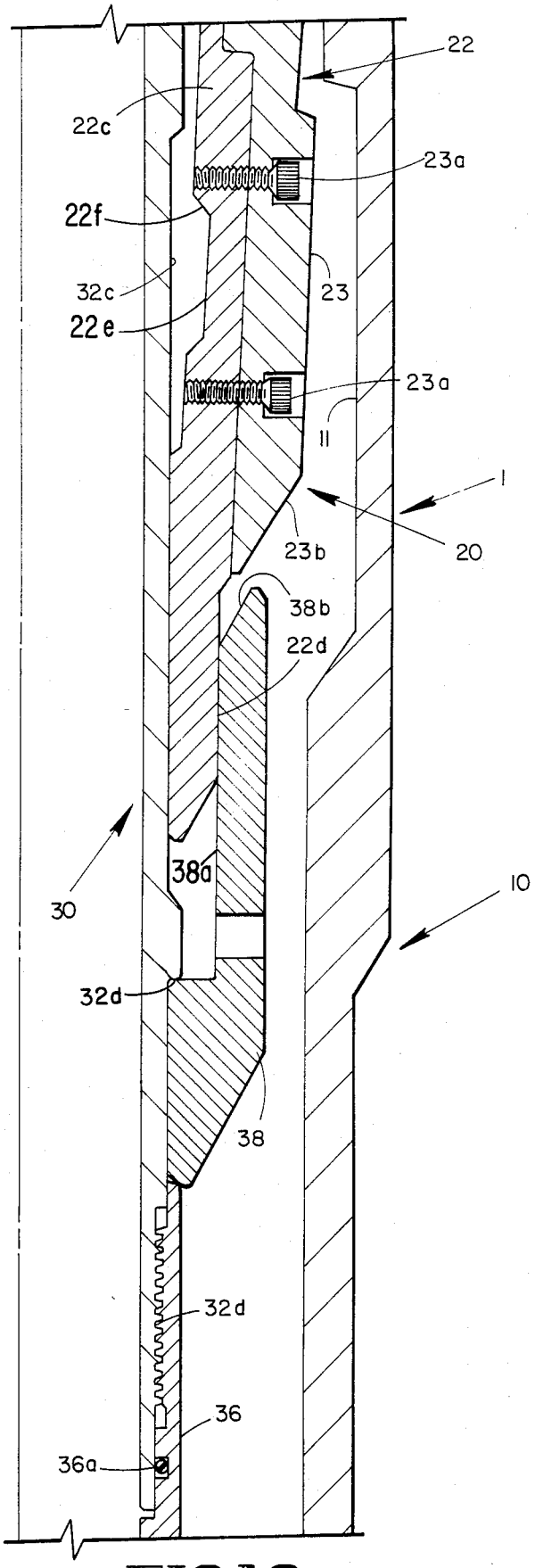

The inner tubular assembly 20 is secured in the run-in position illustrated in FIGS. 1A, 1B, and 1C by one or more shear screws 25 which pass through the ring portion 22*a* of collet 22 and engage an annular recess 40*b* formed in the lug mounting sleeve 40. In this position, the lower ends 22*d* of the collet arms are secured within retention sleeve 38. It is therefore apparent that the locking heads 23 of collet 22 are positively retained against any outward movement and the assemblage can readily be inserted within the well conduit, thus bringing the downwardly facing no-go shoulder 24*b* of the inner tubular assembly 20 into engagement with the upwardly facing no-go shoulder 10*g* provided in the outer tubular assembly 10.

When these no-go shoulders are engaged, further downward movement of the mandrel 30 will effect the shearing of shear screws 25 and thus permit the block carrying sleeve 40 to move downwardly with the mandrel 30 due to the engagement of the upper wall of recess 32*b* with the locking lugs 42. The downward movement of the mandrel 30 is continued until the locking lugs 42 are positioned directly adjacent the locking heads 23 provided on the bottom end of the collet 22 (FIG. 2C). The locking arms 22*b* are each provided with a recess 22*e* which is shaped to receive the respective locking lugs 42 and has a downwardly inclined top end surface 22*f*. Concurrently, the collet retention portion 38*a* of retention sleeve 38 will have been moved off of its overlapping position relative to the bottom ends 22*d* of collet arms 22*b* and the collet arms 22*b* are free to be cammed outwardly into a locking position in the recess 11 by the locking lugs 42.

Figure 2B:
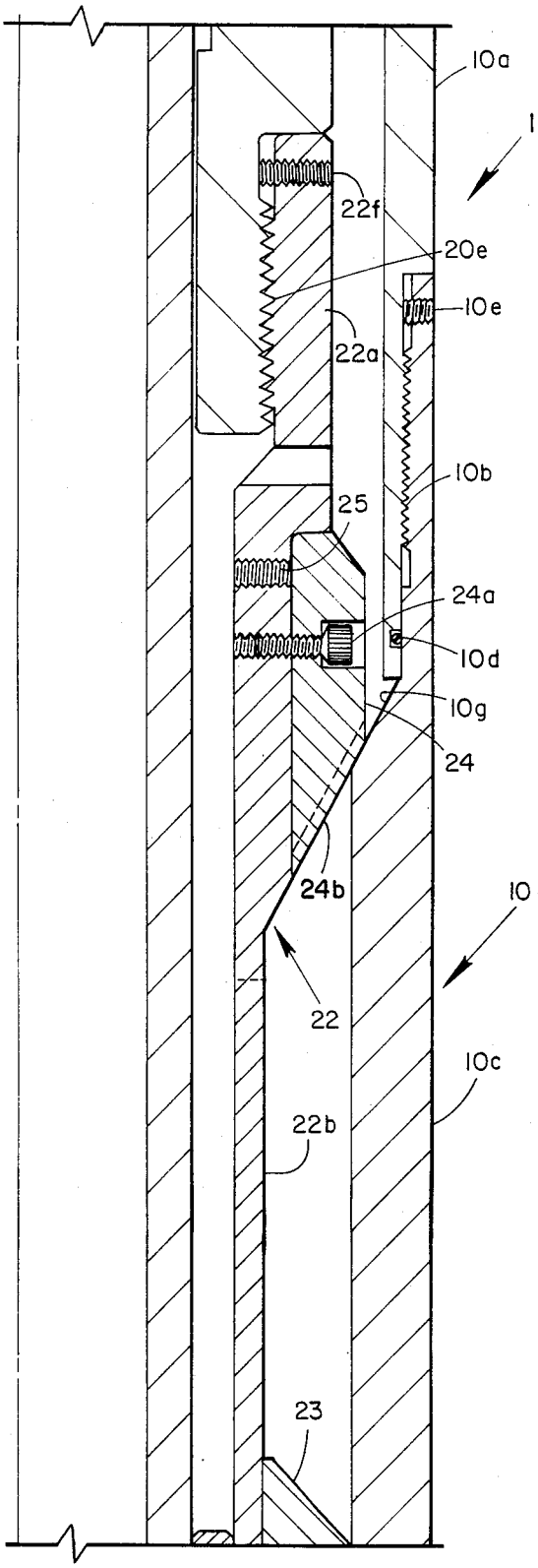
FIGS. 2B, and 2C are respectively similar to FIGS. 1B, and 1C, but show the position of the elements when the mandrel is moved downwardly relative to the collet locking arms and such locking arms are engaged with the annular locking recess in the outer tubular assembly.
Figure 2C:
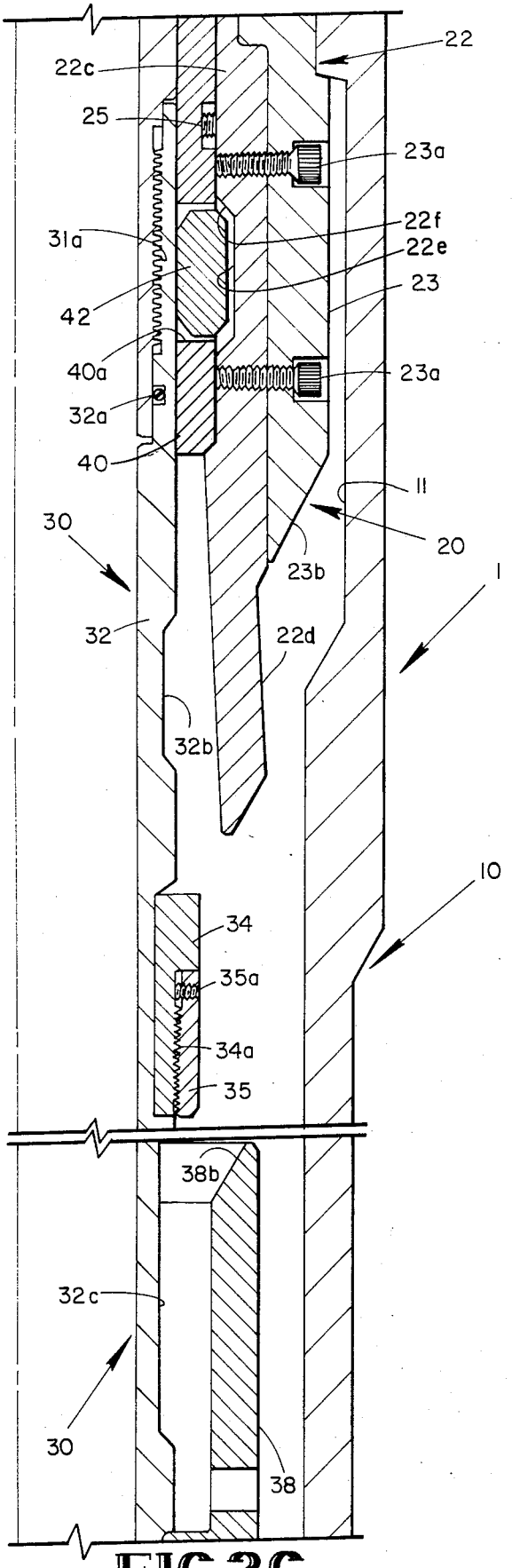

The elements of the apparatus thus assume the position illustrated in FIGS. 2B and 2C. The elements shown in FIG. 1A do not shift in their relative positions except for the fact that the upper portion 31 of mandrel 30 has moved downwardly with respect to the other portions of the device. In this position, the annulus between the exterior of the mandrel 30 and the interior bore of the outer tubular assembly 10 is sealed against fluid passage through the cooperation of the molded seals 21*a* with the bore of the upper outer tubing assembly 10*a* and the cooperation of the internal seal stack 26 with the external surface of the upper mandrel portion 31. Any desired operations can then be accomplished such as formation treatment or cementing by utilizing the bore of the mandrel 30 for transporting the treating fluids.

When the treating operations are completed and it is desired to remove the mandrel assembly 30 and the inner tubular body assembly from the well, this is conveniently accomplished by upward movement of the mandrel assembly 30. The upward movement of the mandrel causes an annular recess 32*b* provided on the periphery of the intermediate mandrel assembly 32 to be moved adjacent the inner faces of the locking lugs or blocks 42. Concurrently, the upward movement of the mandrel results in the abutment sleeve 34 engaging the bottom end of the block carrying sleeve 40 to move such sleeve upwardly. Hence, the lugs 42 are cammed inwardly by inclined surface 22*f* of recess 22*e* to rest in the mandrel recess 32*b*. At the same time, the inclined surface 38*d* on the top end of the retention sleeve 38 is moved into engagement with a similarly inclined surface 23*b* formed on the bottom end of the collet heads 23. Thus, the collet heads are cammed out of engagement with the recess 11 in the other tubular housing 10. Further upward movement of the mandrel 30 brings the lug mounting sleeve 40 into engagement with the bottom end of the inner tubular assembly 20 and the entire inner tubular assembly 20 will be removed from the well with the mandrel 30. Thus, there are no internally projecting bushings that require milling operations to remove for subsequent treatment or production operations of the well.

From the foregoing description, it will be apparent that size changes to accomodate larger or smaller dimensions of the production string can be made by replacing only three components, namely molded seal 21, no-go shoulder 24 and locking heads 23. Of course, the outer tubular assembly 10, which remains in the well, will have its size changed to correspond to the new size of the production tubing.

Figure 4:
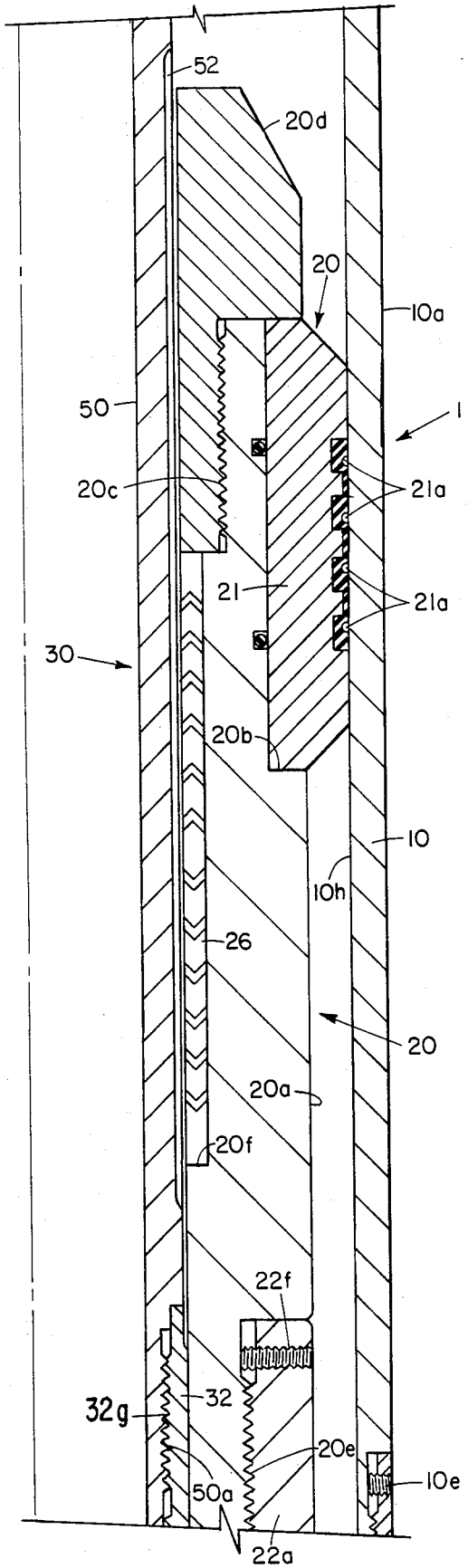
FIG. 4 represents a quarter-sectional view of a modified mandrel for a retrievable bushing assembly shown in its retrieving position.

In some applications, it is desirable to relieve any pressure differential that may exist across the inner seal assembly 26 during the retrieval of the mandrel assembly 30 and the inner tubular assembly 20. Such pressure equalization may be conveniently accomplished with the modified mandrel assembly illustrated in FIG. 4, wherein similar numbers represent parts identical to those previously described. The only difference between the mandrel assembly 30 shown in FIG. 4 over that shown in the remainder of the drawings is the incorporation in the mandrel assembly of a pressure equalization sub 50 between the upper mandrel section 31 and the intermediate mandrel section 32. Pressure equalization sub 50 is provided with internal threads (not shown) to cooperate with the threads 31*a* provided on the upper mandrel section 31 and, at its lower end, provided with external threads 50*a* to cooperate with the internal threads 32*g* of the intermediate mandrel section 32. Additionally, the pressure equalization sub 50 is provided with an axially extending annular recess 52 which is a length greater than the length of the internal seal assembly 26. Thus, when the mandrel assembly 30 is raised to its retrieval position, the annular recess 52 provides a fluid flow passage to equalize any fluid pressure differential that may exist above and below the internal seal assembly 26. Such pressure equalization will, of course, greatly facilitate the removal of the mandrel 30 and the internal tubing assembly 20.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A retreivable bushing for insertion in a well conduit comprising: an outer tubular assembly insertable in series relation in the well conduit; said outer tubular assembly defining a seal bore in its upper portions and an annular locking recess below said seal bore; an inner tubular body assembly concentrically inserted in said outer tubular body assembly; said inner tubular body assembly having an external annular seal mounted thereon and in sealing engagement with said seal bore; and internal annular seal stack mounted in the bore of said inner tubular body assembly; a collet unit having a ring portion and a plurality of peripherally spaced locking arms; said ring portion being secured to said inner tubular body assembly and said locking arms having head portions engagable with said locking recess; a work string-carried mandrel insertable through the bore of said inner tubular body assembly; said mandrel being sealingly engaged with said internal seal stack and defining an annular space within said collet locking arms; locking block means mounted on said mandrel within said annular space and engagable with said collet locking arms to hold said locking heads in said locking recess; an external recess on said mandrel movable into alignment with said locking block means by upward movement of said mandrel to permit said locking arms to be cammed inwardly and released from said locking recess, thereby permitting removal of both said mandrel and said inner tubular body assembly from the well; and means on said mandrel defining an axially extending fluid passage having a length greater than the length of said internal seal stack; said fluid passage means being located on said mandrel to bypass fluid around said internal seal stack when said mandrel is moved upwardly after releasing said locking arm.

2. A retrievable bushing for insertion in a well conduit comprising: an outer tubular assembly insertable in series relation in the well conduit, said outer tubular assemblage defining a seal bore in its upper portions and an annular locking recess below said seal bore; an inner tubular body assembly concentrically inserted in said outer tubular body assembly; said inner tubular body assembly having an external annular seal mounted thereon and in sealing engagement with said seal bore; an internal annular seal stack mounted in the bore of said inner tubular body assembly; a collet unit having a ring portion and a plurality of peripherally spaced locking arms; said ring portion being secured to said inner tubular body assembly and said locking arms having head portions engagable with said locking recess; said outer tubular assembly further defining an upwardly facing no-go surface; said inner tubular body assembly defining a downwardly facing no-go surface engagable with said upwardly facing no-go surface when said head portions of said collet locking arms are adjacent said annular locking recess; a work string-carried mandrel insertable through the bore of said inner tubular body assembly; said mandrel being sealingly engaged with said internal seal stack and defining an annular space within said collet locking arms; locking block means mounted on said mandrel within said annular space and engagable with said collet locking arms to hold said locking heads in said locking recess; an external recess on said mandrel movable into alignment with said locking block means by upward movement of said mandrel to permit said locking arms to be cammed inwardly and released from said locking recess, thereby permitting removal of both said mandrel and said inner tubular body assembly from the well.

3. The apparatus of claim 2 wherein said locking block means comprises a lock mounting sleeve freely mounted on said mandrel within said annular space and having a plurality of peripherally spaced wall openings; and a locking block insertable in each opening for radial movements relative to said lock mounting sleeve.

4. The apparatus of claim 2 further comprising an upwardly facing shoulder on said mandrel engagable with lock mounting sleeve by upward movement of said mandrel to remove said inner tubular body assembly from the well.

5. The apparatus of claim 2 further comprising a retention sleeve secured to said mandrel and overlapping the lower end portions of said collet arms in the run-in position of said mandrel relative to said tubular inner body assembly to hold same in a radially retracted position; and shearable means securing said mandrel to said tubular inner body assembly during run-in until said upwardly and downwardly facing no-go surfaces are engaged, whereby further downward movement of said mandrel shears said shearable means and releases said collet locking arms from said retention sleeve.

6. The apparatus of claim 5 further comprising a camming surface on the upper end of said retention sleeve engagable with the ends of said collet locking arms to cam same to a radially retracted position upon upward withdrawal movement of said mandrel.

7. The apparatus of claim 2 further comprising means on said mandrel defining an axially extending fluid passage having a length greater than the length of said internal seal stack; said fluid passage means being located on said mandrel to bypass fluid around said internal seal stack when said mandrel is moved upwardly after releasing said locking arms.

* * * * *